US005343614A

United States Patent [19]

Betz et al.

[11] Patent Number: 5,343,614

[45] Date of Patent: Sep. 6, 1994

[54] METHOD FOR MANUFACTURING COILS

[75] Inventors: Dieter Betz, Vaihingen/Enz; Karl-Heinz Nuebel, Schwieberdingen, both of Fed. Rep. of Germany; José Luis Almendro, Madrid, Spain; Fernando Garcia, Madrid, Spain; Eduardo Ramirez, Madrid, Spain

[73] Assignee: Robert Bosch GmbH, Stuttgart, Fed. Rep. of Germany

[21] Appl. No.: 920,301

[22] PCT Filed: Nov. 19, 1991

[86] PCT No.: PCT/DE91/00906

§ 371 Date: Aug. 10, 1992

§ 102(e) Date: Aug. 10, 1992

[87] PCT Pub. No.: WO92/11648

PCT Pub. Date: Jul. 9, 1992

[30] Foreign Application Priority Data

Dec. 19, 1990 [DE] Fed. Rep. of Germany ..... 4040604

[51] Int. Cl.[5] ..... H01F 41/06

[52] U.S. Cl. ..... 29/605; 29/606; 264/272.19

[58] Field of Search ..... 29/605, 606; 264/272.19; 336/96

[56] References Cited

U.S. PATENT DOCUMENTS

| | | | |
|---|---|---|---|
| 2,856,639 | 10/1958 | Forrest et al. | 29/605 X |
| 3,443,136 | 5/1969 | Freeman et al. | 29/605 X |
| 3,458,928 | 8/1969 | Crawford et al. | 29/605 |
| 4,179,796 | 12/1979 | Allen | 29/605 |
| 4,580,122 | 4/1986 | Worz | 29/606 X |
| 4,586,016 | 4/1986 | Rilly et al. | 29/606 X |

FOREIGN PATENT DOCUMENTS

| | | |
|---|---|---|
| 353443 | 2/1980 | European Pat. Off. . |
| 125619 | 11/1984 | European Pat. Off. . |
| 0154862 | 9/1985 | European Pat. Off. . |
| 7141337 | 4/1972 | Fed. Rep. of Germany . |
| 2554747 | 6/1977 | Fed. Rep. of Germany . |
| 3433065 | 3/1986 | Fed. Rep. of Germany . |
| 2334268 | 7/1977 | France . |

OTHER PUBLICATIONS

Patent Abstracts of Japan vol. 7, No. 214 (E-199) (1359).

Patent Abstracts of Japan vol. 4, No. 181 (E-37) (663).

Patent Abstracts of Japan vol. 5, No. 99 (E-63).

Patent Abstracts of Japan, vol. 14, No. 316 (E-94).

Patent Abstracts of Japan, vol. 12, No. 393 (E-670).

*Primary Examiner*—Carl E. Hall

*Attorney, Agent, or Firm*—Michael J. Striker

[57] ABSTRACT

A coil is produced by wrapping a primary winding of the coil onto a core rod of a wrapping machine, arranging a secondary winding of the coil on a winding form and pushing it coaxially over the primary winding, pulling the core rod out of the primary winding, simultaneously inserting an iron core into the primary winding, and moving along a housing which accommodates the iron core onto the ignition coil, and filling the housing with casting resin to form a plastic block which surrounds at least the primary winding.

1 Claim, 2 Drawing Sheets

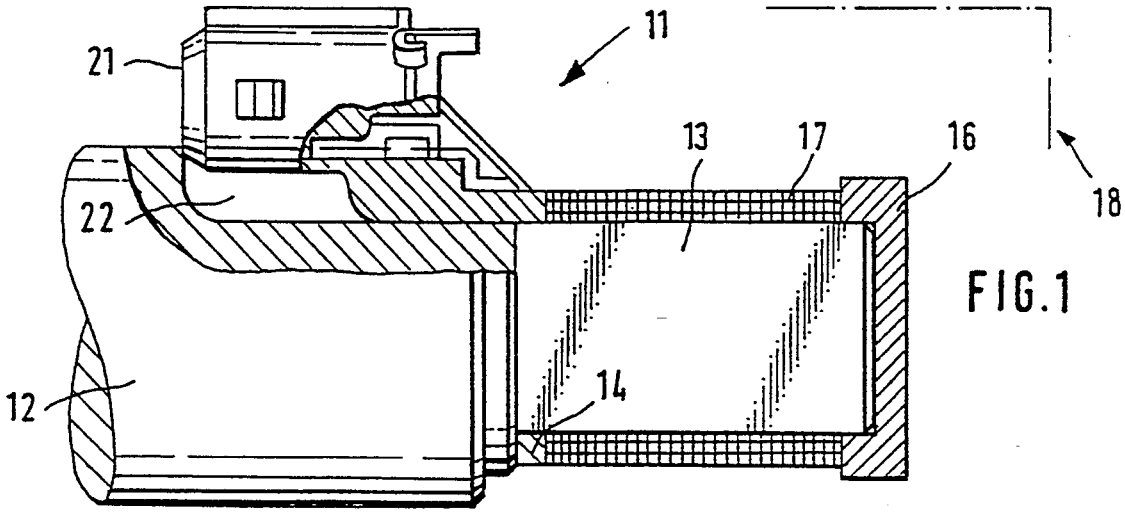
FIG. 1
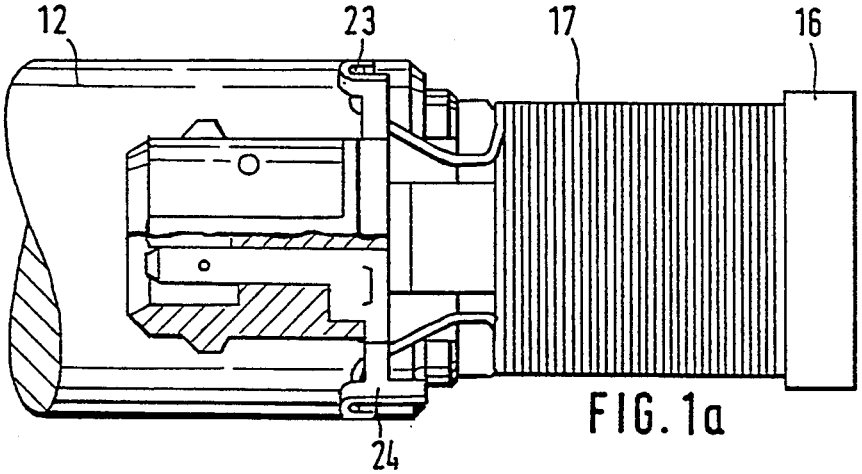
FIG. 1a
FIG. 2
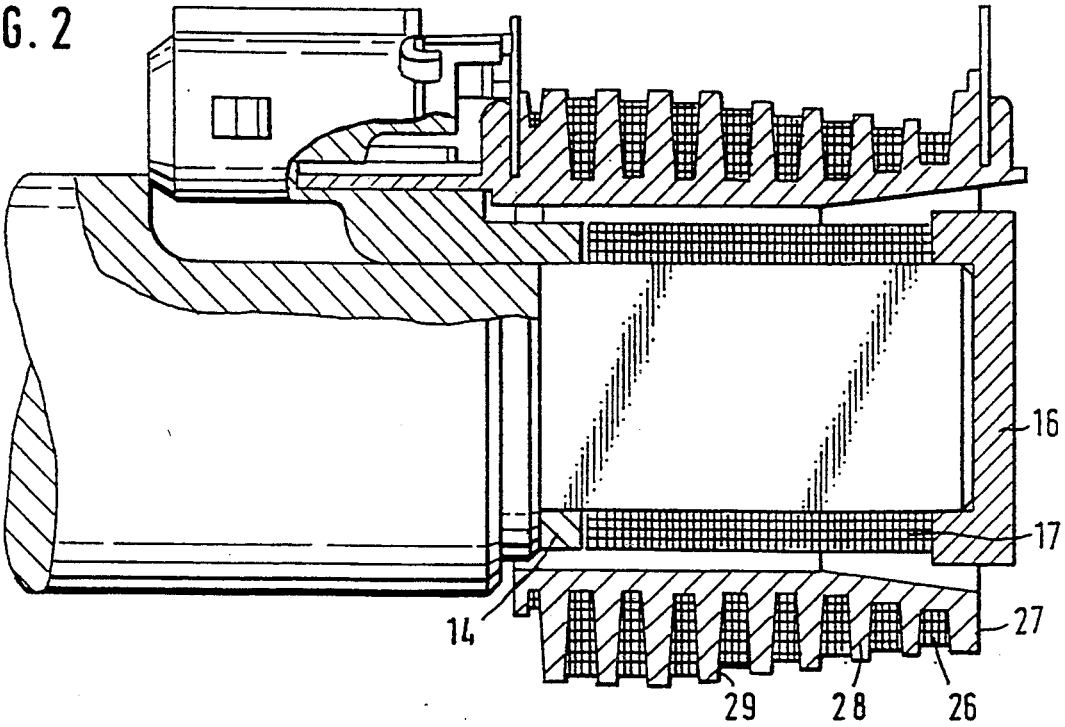

METHOD FOR MANUFACTURING COILS

BACKGROUND OF THE INVENTION

The present invention relates to a method and device for manufacturing coils.

More particularly, it relates to a method for manufacturing coils, in particular ignition coils for ignition systems of internal combustion engines, of the type having a housing, an iron core in the housing, primary and secondary windings and a plastic block enclosing at least the primary winding.

In known ignition coils, in each case a winding form is used for their primary winding and secondary winding. In order to obtain the highest possible power yield in an ignition coil of a predetermined constructional size, the heat produced in its windings during operation must be effectively conducted away. This applies in particular to the primary winding which is covered by the secondary winding and whose maximum operating temperature ultimately limits the efficiency of the ignition coil.

SUMMARY OF THE INVENTION

Accordingly, it is an object of the present invention to provide a method of manufacturing coils, in accordance with which a primary winding is first wrapped onto a core rod of a wrapping machine, a secondary winding is arranged on a winding form and pushed coaxially over the primary winding and when thereafter the core rod is pulled out of the primary winding an iron core accommodated in a housing with respect to the core rod is inserted into the primary winding, while the housing which is carried along with the iron core and encloses the ignition coil is filled with casting resin forming the plastic block.

The method performed in accordance with the present invention has characterising features of claim 1 has the advantage that the primary winding of the ignition coil can be produced without winding forms and the heat transfer from the primary winding to the directly adjacent iron core can take place particularly effectively. As a result, it is possible with such an ignition coil with predetermined external diameters to obtain a power yield which is increased in comparison with an ignition coil of conventional design.

In accordance with another feature of the present invention the secondary winding is connected at its end with a connection of the end of the secondary winding to the high-voltage terminal is provided which favourable in terms of production technology.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a partial section of a wrapping machine with a core rod and a primary winding of a coil to be wound on the core rod;

FIG. 1*a* is a top view of FIG. 1;

FIG. 2 is a view illustrating a further step of the method of producing the coil, in which a secondary winding is produced and mounted coaxially to the primary winding;

In FIG. 1 of the drawing a diagrammatic view of a partial section through a wrapping machine 11 is shown with a drive element 12 which has a cylindrical base shape and a core rod 13 which is shaped as a shaft stub, is attached coaxially to said element and is offset with respect to the drive element 12.

Figure 3:
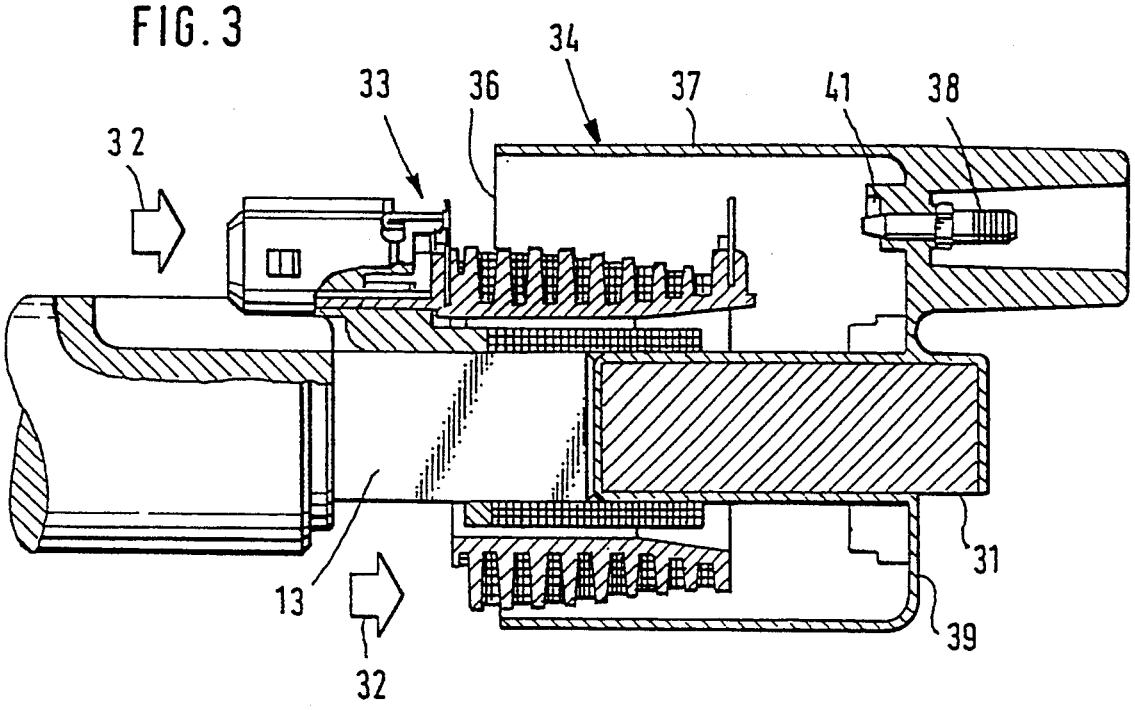
FIG. 3 is a view showing still a further step of the inventive method in which an iron core is attached to the core rod, and other parts of the coil cooperate with it.
Figure 4:
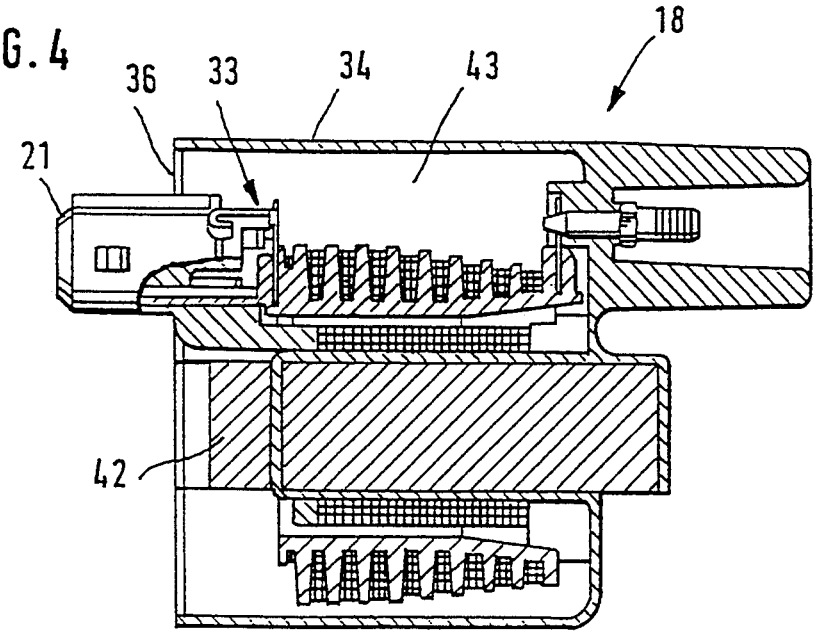
FIG. 4 is a view showing a final step of the method in accordance with the present invention.

The core rod 13 has at its two ends flange-like boundary elements as a collar 14 and stop 16 which bound the wrapping area for a primary winding 17 to be wrapped onto the core rod for an ignition coil 18 which is indicated, and which boundary elements have a diameter which is at least equal in size to the external diameter of the primary winding 17.

The collar 14 is part of a connection plug 21 which is pushed over the core rod 13 before the primary winding 17 is wrapped and is mounted fixed in terms of rotation in an axial groove 22 attached in the drive element 12.

The stop 16 is reversibly joined to the free end of the core rod 13 by means which are not shown.

By rotating the drive element 12 with the core rod 13, the primary winding 17 is wrapped in a known manner with means (not illustrated in greater detail) onto the core rod 13 between the collar 14 and the stop 16 in the form of a layered winding and. As shown in FIG. 1*a* of the top view of the subject of FIG. 1, the start of the primary coil 17 is connected to a first connecting element 23 and the end of the primary coil 17 is connected to a second connecting element 24 by welding, it being possible also to use other connecting techniques such as, for example, soldering or clamping.

The two connecting elements 23, 24 are electrically insulated from one another in a customary fashion.

In a further method step, a secondary winding 26 is produced and mounted coaxially with respect to the primary winding 17, as illustrated in FIG. 2.

The hollow cylindrical winding form 27 which bears the secondary winding 26 is divided up into a plurality of chambers 29 by radially directed webs 28 which point away from the core rod 13. By means of the chamber windings connected in series the voltage difference between the individual chambers 29 is limited and voltage flashovers within the secondary winding 26 are thus avoided.

After the winding form 27 is mounted with fixing on the connecting plug 21, the start of the secondary winding 26 is connected to the second connecting element 24.

In a further work process, the stop 16 is removed and an iron core 31 is attached coaxially to the now free end of the core rod 13, as shown in FIG. 3. The iron core 31 is encapsulated by injection moulding in an electrically insulating skin-forming manner. The encapsulated iron core 31 has the same, preferably quadratic or rectangular cross sectional shape as the core rod 13. The encapsulated iron core 31 and the core rod 13 have the same outer dimensions. The outer dimensions of the encapsulated iron core 31 could however also be smaller than the outer dimensions of the core rod 13 by a joint play.

In accordance with the arrow 32, the structure 33 consisting of the primary winding 17, secondary winding 26 and connecting plug 21 is pushed onto a part of the iron core 31 in the axial direction of the core rod 13 over its free end. As result, the iron core assumes the supporting effect for the primary winding 17.

The iron core 31 is fixed in a pot-shaped housing 34. Its open cover side 36 points towards the drive element 12 and its exterior surface 37 is directed parallel to the core rod 13 so that with the pushing on of the structure 33 onto the iron core it dips so far into the housing 34 that only part of the connecting plug 21 projects beyond the latter.

The secondary winding 26 is connected at one end to a high-voltage terminal 38 which penetrates the housing 34 on its floor side 39. The connection is made by means of a conductive adhesive 41. It could however also be made differently, for example be plugged. The iron core 31 is supplemented by a transverse yoke 42 and the cover side 36 of the housing 34 is closed in such a way that the part of the connecting plug 21 which projects beyond the housing 34 is sealed off from an interior space 43 which is now enclosed by the housing 34.

The housing 34 which is closed on all sides is dried on the inside by means (not illustrated) and filled with casting resin which forms a plastic block around the structure 33 and stabilises its arrangement.

As an alternative to the previously described exemplary embodiment, in the ignition coil 18 produced in this way the core rod 13 and the iron core 31 can have a different cross-sectional surface, for example with a round cross-sectional surface.

With the described method, it is possible, in the ignition coil 18 manufactured, while retaining the winding form 27 for the secondary winding 26, which form is required because of the necessary high-voltage electric strength, to dispense with the winding form for the primary winding 17 and to quickly conduct away the waste heat from the primary winding 17 by means of the iron core 31 resting directly against the primary winding 17. It is thereby possible to provide an ignition coil 18 which, in comparison with an ignition coil of conventional design, having in each case one winding form for the primary winding 17 and the secondary winding 26, permits a power yield which is increased in relation to the constructional volume of the ignition coil 18.

At the same time, for example with a constant power yield of the ignition coil 18, its constructional size can be reduced, which corresponds to the trend in vehicle component design.

It will be understood that each of the elements described above, or two or more together, may also find a useful application in other types of methods differing from the types described above.

While the invention has been illustrated and described as embodied in a method for manufacturing coils, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed as new and desired to be protected by Letters Patent is set forth in the appended claims.

We claim:

1. A method of manufacturing a coil having a housing accommodating an encapsulated electrically insulated iron core, primary and secondary windings arranged in the housing, and a plastic block enclosing at least the primary winding, the method comprising the steps of wrapping a primary winding onto a core rod of a wrapping machine; arranging a secondary winding on a winding form; pushing the secondary winding on the winding form coaxially over the primary winding; pushing the secondary winding with the primary winding onto the encapsulated iron core so that the core rod is withdrawn out of the primary winding and the encapsulated iron core is arranged coaxially with respect to the core rod directly in the primary winding without intermediate elements while the housing connected with the encapsulated iron core encloses the primary winding and the secondary winding; and filling the housing with casting resin to form the plastic block.

* * * * *